US011136653B2

(12) United States Patent
Um et al.

(10) Patent No.: US 11,136,653 B2
(45) **Date of Patent: *Oct. 5, 2021**

(54) HIGH-STRENGTH STEEL MATERIAL HAVING EXCELLENT LOW-TEMPERATURE STRAIN AGING IMPACT PROPERTIES AND WELDING HEAT-AFFECTED ZONE IMPACT PROPERTIES AND METHOD FOR MANUFACTURING SAME

(71) Applicant: POSCO, Pohang-si (KR)

(72) Inventors: Kyung-Keun Um, Pohang-si (KR); Woo-Gyeom Kim, Pohang-si (KR)

(73) Assignee: POSCO, Pohang-si (KR)

( * ) Notice: Subject to any disclaimer, the term of this patent is extended or adjusted under 35 U.S.C. 154(b) by 432 days.

This patent is subject to a terminal disclaimer.

(21) Appl. No.: 16/061,538

(22) PCT Filed: Dec. 15, 2016

(86) PCT No.: PCT/KR2016/014730
§ 371 (c)(1),
(2) Date: Jun. 12, 2018

(87) PCT Pub. No.: WO2017/105107
PCT Pub. Date: Jun. 22, 2017

(65) Prior Publication Data

US 2020/0263279 A1 Aug. 20, 2020

(30) Foreign Application Priority Data

Dec. 15, 2015 (KR) ..... 10-2015-0178988

(51) Int. Cl.
*C22C 38/00* (2006.01)
*C22C 38/02* (2006.01)
(Continued)

(52) U.S. Cl.
CPC ..... *C22C 38/001* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS

2008/0295920 A1* 12/2008 Kumagai ..... C21D 9/46 148/330
2017/0022583 A1 1/2017 Yasuda et al.

FOREIGN PATENT DOCUMENTS

CN 103874558 A 6/2014
EP 2764946 A1 8/2014
(Continued)

OTHER PUBLICATIONS

International Search Report dated Mar. 20, 2017 issued in International Patent Application No. PCT/KR2016/014730 (with English translation).

(Continued)

*Primary Examiner* — Anthony M Liang
(74) *Attorney, Agent, or Firm* — Morgan, Lewis & Bockius LLP

(57) ABSTRACT

The present invention relates to a steel material for pressure vessels, offshore structures and the like and, more specifically, to a high-strength steel material having excellent low-temperature strain aging impact properties and a method for manufacturing same.

5 Claims, 1 Drawing Sheet

(51) Int. Cl.

| | |
|---|---|
| ***C22C 38/06*** | (2006.01) |
| ***C21D 8/02*** | (2006.01) |
| ***C21D 9/46*** | (2006.01) |
| ***C22C 38/58*** | (2006.01) |
| ***C22C 38/50*** | (2006.01) |
| ***C22C 38/48*** | (2006.01) |
| ***C22C 38/46*** | (2006.01) |
| ***C22C 38/42*** | (2006.01) |
| ***C22C 38/44*** | (2006.01) |

(52) U.S. Cl.

CPC ..... *C21D 8/0263* (2013.01); *C21D 9/46* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/001* (2013.01); *C21D 2211/002* (2013.01); *C21D 2211/005* (2013.01); *C21D 2211/008* (2013.01); *C21D 2211/009* (2013.01)

(56) References Cited

FOREIGN PATENT DOCUMENTS

| | | | | |
|---|---|---|---|---|
| EP | 2832889 | A1 | | 2/2015 |
| JP | 2012-241266 | A | | 12/2012 |
| JP | 2014-043627 | A | | 3/2014 |
| KR | 10-1988-0007754 | A | | 8/1986 |
| KR | 10-2011-0060449 | A | | 6/2011 |
| KR | 10-2012-0074638 | A | | 7/2012 |
| KR | 10-2013-0034197 | A | | 4/2013 |
| KR | 10-2013-0076569 | A | | 7/2013 |
| KR | 20130076569 | A | * | 7/2013 |
| KR | 10-2013-0120346 | A | | 11/2013 |
| KR | 10-2014-0003009 | A | | 1/2014 |
| KR | 10-2014-0030465 | A | | 3/2014 |
| KR | 10-2015-0124810 | A | | 11/2015 |
| WO | 2015/151468 | A1 | | 10/2015 |
| WO | 2017/105107 | A1 | | 6/2017 |
| WO | 2017/105109 | A1 | | 6/2017 |

OTHER PUBLICATIONS

I. Ochiai, et al., "Effect of Titanium Addition on Strain Aging of Low-Carbon Steel Wire Rod," Kimitsu R & D Lab., Nippoin Steel Corp., Jul. 1988, pp. 642-649.

V. K. Heikkinen, et al., "The effect of processing vairables on the mechanical properties and strain ageing of high-strength low-alloy V and V-N steels," Canadian Metallurgical Quarterly, vol. 15, No. 3, 1976, pp. 219-226 (with English translation).

European Search Report dated Jan. 29, 2019 issued in European Patent Application No. 16876049.4 (with English translation).

Chinese Office Action dated Jul. 23, 2019 issued in Chinese Patent Application No. 201680073035.5 (with English translation).

I. Ochiai, et al., "Effect of Titanium Addition on Strain Aging of Low-Carbon Steel Wire Rod," Kimitsu R & D Lab., Nippoin Steel Corp., Jul. 1988, pp. 642-649 (with English translation).

V. K. Heikkinen, et al., "The effect of processing vairables on the mechanical properties and strain ageing of high-strength low-alloy V and V-N steels," Canadian Metallurgical Quarterly, vol. 15, No. 3, 1976, pp. 219-226.

* cited by examiner

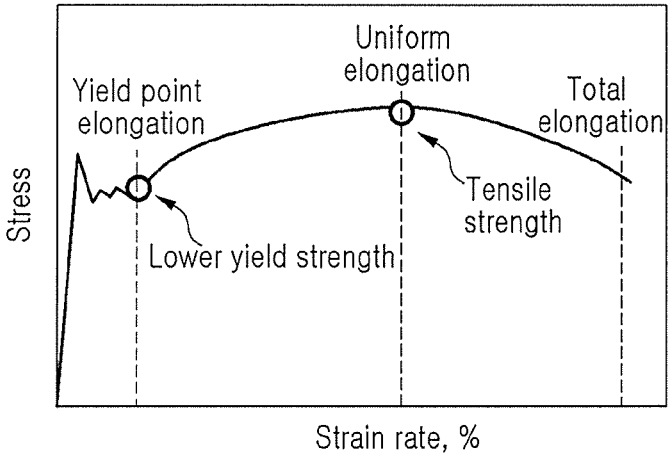
Uniform
elongation
Yield point
elongation
Total
elongation
Tensile
strength
Lower yield strength
Stress
Strain rate, %

HIGH-STRENGTH STEEL MATERIAL HAVING EXCELLENT LOW-TEMPERATURE STRAIN AGING IMPACT PROPERTIES AND WELDING HEAT-AFFECTED ZONE IMPACT PROPERTIES AND METHOD FOR MANUFACTURING SAME

CROSS REFERENCE

This patent application is the U.S. National Phase under 35 U.S.C. § 371 of International Application No. PCT/KR2016/014730, filed on Dec. 15, 2016, which claims the benefit of Korean Patent Application No. 10-2015-0178988, filed on Dec. 15, 2015, the entire contents of each are hereby incorporated by reference.

TECHNICAL FIELD

The present disclosure relates to a steel material used as a material for pressure vessels, offshore structures and the like, and more particularly, to a high-strength steel material having excellent low-temperature strain aging impact properties and welding heat-affected zone impact properties, and a method for manufacturing the same.

BACKGROUND ART

Recently, mining areas have moved to deep-sea areas or areas of extreme cold due to the exhaustion of energy resources, and thus, mining and storage facilities are becoming larger and more complicated. Steel materials used therein are required to have excellent low-temperature toughness for securing high strength and facility stability for reducing weight.

Meanwhile, since cold deformation often occurs in the course of manufacturing a steel material having strength and toughness as described above to form a steel pipe or other complicated structures, the steel material is required to significantly avoid a decrease in toughness due to strain aging by cold deformation.

The mechanism of decreased toughness due to strain aging is as follows: The toughness of a steel material measured by a Charpy impact test is explained by a correlation between yield strength and fracture strength at the test temperature; and when the yield strength of a steel material at the test temperature is higher than the fracture strength, the steel material undergoes brittle fracture without ductile fracture, so that an impact energy value is lowered, but when the yield strength is lower than the fracture strength, the steel material is deformed to be ductile, thereby absorbing impact energy during work hardening, and being changed to undergo brittle fracture when the yield strength reaches fracture strength. That is, as the difference between the yield strength and the fracture strength is larger, the amount of the steel material deformed to be ductile is increased, so that the impact energy to be absorbed is increased. Therefore, when subjecting the steel material to cold deformation for manufacturing to form a steel pipe or other complicated structure, the yield strength of the steel material is increased as deformation continues, and thus, the difference from the fracture strength becomes smaller, which is accompanied by decreased impact toughness.

Thus, in order to prevent decreased toughness by cold deformation, conventionally, a method of significantly decreasing the amount of carbon (C) or nitrogen (N) which is employed in the steel material, or adding an element (e.g., titanium (Ti), vanadium (V), etc.) to precipitate those elements at a minimum amount or more, for suppressing strength increase by an aging phenomenon after deformation, a method of performing SR (stress relief) heat treatment after cold deformation to decrease dislocation and the like produced in the steel material, thereby lowering the yield strength increased by work hardening, a method of adding an element (e.g., nickel (Ni), etc.) to lower stacking fault energy to facilitate the movement of dislocations, for increasing ductility of the steel material at low temperature, and the like have been suggested, and applied.

However, as structures and the like are continuously becoming larger and more complicated, the cold deformation amount required for the steel material is increased, and also the temperature of a use environment is lowered to the level of arctic sea temperature. Thus, it is difficult to effectively prevent toughness decrease by strain aging of the steel material, with conventional methods.

Moreover, in order to increase efficiency of a welding process which has the greatest influence on the productivity of structures and the like, a welding heat input amount should be increased to reduce the number of welding passes, but as the welding heat input amount is increased, the structure of welding heat affected zone may be coarser, resulting in deterioration of impact properties at low temperature.

(Non-patent document 1) Effect of Ti addition on strain aging of low-carbon steel wire rod (Ikuo Ochiai, Hiroshi Ohba, Iron and Steel, Volume 75 (1989), issue 4, p. 642-)

(Non-patent document 2) The effect of processing variables on the mechanical properties and strain ageing of high-strength low-alloy V and V-N steels (V. K. Heikkinen and J. D. Boyd, CANADIAN METALLURGICAL QUARTERLY Volume 15 Number 3 (1976), p. 219-)

DISCLOSURE

Technical Problem

An aspect of the present disclosure is to provide a steel material which may not only secure high strength and high toughness, but may also significantly avoid a strength increase due to cold deformation, and has excellent welding heat-affected zone impact properties, thereby being appropriately applied as a material of pressure vessels, offshore structures and the like, and a method for manufacturing the same.

Technical Solution

According to an aspect of the present disclosure, a high-strength steel material having excellent low-temperature strain aging impact properties and welding heat-affected zone impact properties includes 0.04-0.14 wt % of carbon (C), 0.05-0.60 wt % of silicon (Si), 0.6-1.8 wt % of manganese (Mn), 0.005-0.06 wt % of soluble aluminum (sol. Al), 0.005-0.05 wt % of niobium (Nb), 0.01 wt % or less (exclusive of 0 wt %) of vanadium (V), 0.012-0.030 wt % of titanium (Ti), 0.01-0.4 wt % of copper (Cu), 0.01-0.6 wt % of nickel (Ni), 0.01-0.2 wt % of chromium (Cr), 0.001-0.3 wt % of molybdenum (Mo), 0.0002-0.0040 wt % of calcium (Ca), 0.006-0.012 wt % of nitrogen (N), 0.02 wt % or less (exclusive of 0 wt %) of phosphorus (P), and 0.003 wt % or less (exclusive of 0 wt %) of sulfur (S), with a balance of Fe and other inevitable impurities, and includes a mixed structure of ferrite, pearlite, bainite and a martensite-austenite (MA) composite phase as a microstructure, wherein a fraction of the MA phase is 3.5% or less (exclusive of 0%).

According to another aspect of the present disclosure, a method for manufacturing a high-strength steel material having low-temperature strain aging impact properties includes reheating a steel slab satisfying the above-described component composition to a temperature within a range of 1080-1250° C.; controlled-rolling the reheated slab to a rolling finish temperature of 780° C. or more, thereby manufacturing a hot-rolled steel plate; cooling the hot-rolled steel plate by air cooling or water cooling; and after the cooling, subjecting the hot-rolled steel plate to normalizing heat treatment in a temperature range of 850-960° C.

Advantageous Effects

As set forth above, according to an exemplary embodiment in the present disclosure, a heat-treated steel material having excellent low-temperature stain aging impact properties and also excellent welding heat-affected zone impact properties, simultaneously with high strength may be provided, and the steel material may be appropriately applied as a material for pressure vessels, offshore structures and the like, following a trend of being larger and more complicated.

DESCRIPTION OF DRAWINGS

FIG. 1 is a graph representing lower yield strength and tensile strength in a tensile curve of a steel material according to an aspect of the present disclosure.

BEST MODE FOR INVENTION

As the cold deformation amount for the steel material used as a material for pressure vessels, offshore structures and the like is continuously increased, the present inventors conducted an intensive study into the development of a steel material which may prevent toughness decrease of the steel material by strain aging, have high strength and high toughness, and have excellent low-temperature toughness of a welding heat-affected zone to improve productivity, and as a result, confirmed that a steel material having a microstructure advantageous for securing the above-described physical properties from optimization of a steel component composition and manufacturing conditions may be provided, thereby completing the present disclosure.

In particular, the steel material of the present disclosure may effectively prevent toughness decrease by strain aging by optimizing the contents of the elements having an influence on MA phase formation in the steel component composition to significantly decrease the MA phase (martensite-austenite composite phase).

Hereinafter, the present disclosure will be described in detail.

It is preferable that the high-strength steel material having excellent low-temperature strain aging impact properties and welding heat-affected zone impact properties according to an aspect of the present disclosure includes 0.04-0.14 wt % of carbon (C), 0.05-0.60 wt % of silicon (Si), 0.6-1.8 wt % of manganese (Mn), 0.005-0.06 wt % of soluble aluminum (sol. Al), 0.005-0.05 wt % of niobium (Nb), 0.01 wt % or less (exclusive of 0 wt %) of vanadium (V), 0.012-0.030 wt % of titanium (Ti), 0.01-0.4 wt % of copper (Cu), 0.01-0.6 wt % of nickel (Ni), 0.01-0.2 wt % of chromium (Cr), 0.001-0.3 wt % of molybdenum (Mo), 0.0002-0.0040 wt % of calcium (Ca), 0.006-0.012 wt % of nitrogen (N), 0.02 wt % or less (exclusive of 0 wt %) of phosphorus (P), and 0.003 wt % or less (exclusive of 0 wt %) of sulfur (S).

Hereinafter, the reason why the alloy components of the high-strength steel material provided by the present disclosure are controlled as described above will be described in detail. Herein, unless otherwise stated, the content of each component refers to wt %.

C: 0.04-0.14%

Carbon (C) which is an element advantageous for securing strength of a steel is bonded to pearlite or niobium (Nb), nitrogen (N) and the like to exist as carbonitrides, and thus, is a main element for securing tensile strength. It is not preferable that the content of this Cis less than 0.04%, since the tensile strength on a matrix may be lowered, and when the content is more than 0.14%, pearlite is excessively produced, so that low-temperature strain aging impact properties may be deteriorated.

Therefore, it is preferable in the present disclosure that the content of C be limited to 0.04-0.14%.

Si: 0.05-0.60%

Silicon (Si) which is an element added for a deoxidation and desulfurization effect of a steel, and also for solid solution strengthening is add preferably at 0.05% or more for securing yield strength and tensile strength. However, it is not preferable that the content of silicon is more than 0.60%, since weldability and low-temperature impact properties are lowered, and a steel surface is easily oxidized so that an oxide film may be severely formed.

Therefore, it is preferable in the present disclosure that the content of Si be limited to 0.05-0.60%.

Mn: 0.6-1.8%

It is preferable that manganese (Mn) is added at 0.6% or more, since manganese has a large effect on strength increase by solid solution strengthening. However, when the content of Mn is excessive, segregation becomes severe in the center of a steel plate in the thickness direction, and at the same time formation of MnS which is a nonmetallic inclusion is encouraged together with segregated S. The MnS inclusion produced in the center is stretched by rolling, and as a result, significantly deteriorates low-temperature toughness and lamella tear resistant properties, and thus, it is preferable to limit the content of Mn to 1.8% or less.

Therefore, it is preferable in the present disclosure that the content of Mn be limited to 0.6-1.8%.

Sol. Al: 0.005-0.06%

Soluble aluminum (sol. Al) is used as a strong deoxidizing agent in a steel manufacturing process together with Si, and it is preferable to add at least of 0.005% of sol. Al in deoxidation alone or in combination. However, when the content is more than 0.06%, the above-described effect is saturated, and the fraction of $Al_2O_3$ in the oxidative inclusion produced as a resultant product of deoxidation is increased more than necessary, and the size is larger. Thus, it is not easy to remove it during refining, resulting in significant reduction in low-temperature toughness, and thus, is not preferable.

Therefore, it is preferable in the present disclosure that the content of Sol. Al be limited to 0.005-0.06%.

Nb: 0.005-0.05%

Niobium (Nb) has a large effect of being solid-solubilized in austenite when reheating a slab, thereby increasing hardenability of austenite, and being precipitated as fine carbonitrides (Nb,Ti)(C,N) upon hot rolling, thereby suppressing recrystallization during rolling or cooling to finely form a final microstructure. In addition, as the added amount of Nb is increased, the formation of bainite or MA is promoted to increase strength, however, it is not preferable that the content is more than 0.05%, since it is easy to form excessive MA, or a coarse precipitate in the center in the thickness direction, thereby deteriorating low-temperature toughness in the center of the steel.

Therefore, it is preferable in the present disclosure that the content of Nb be limited to 0.005-0.05%, more advantageously 0.02% or more, still more advantageously 0.022% or more.

V: 0.01% or less (exclusive of 0%)

Vanadium (V) is almost all solid-solubilized again when heating a slab, and thus, there is little effect of strength increase by precipitation or solid solubilization after rolling, normalizing heat treatment. In addition, V is a relatively expensive element, and causes cost increases when added in large amounts, and thus, considering this, it is preferable to add 0.01% or less of V.

Ti: 0.012-0.030%

Titanium (Ti) is present as a hexagonal precipitate mainly in the form of TiN at high temperature, or forms carbonitride (Nb,Ti) (C,N) precipitates with Nb and the like to suppress crystal grain growth in the welding heat-affected zone. For this, it is preferable to add 0.012% or more of Ti, however, when the content is excessive and more than 0.030%, carbonitrides being coarser than necessary is produced in the center of the steel in the thickness direction, and serves as a fracture crack initiation point, thereby rather greatly reducing welding heat-affected zone impact properties.

Therefore, it is preferable in the present disclosure that the content of Ti be limited to 0.012-0.030%.

Cu: 0.01-0.4%

Copper (Cu) has an effect of greatly improve strength by solid solubilization and precipitation, and not greatly affecting strain aging impact properties, however, when excessively added, causes cracks on a steel surface, and is an expensive element, and thus, considering this, it is preferable to limit the content to 0.01-0.4%.

Ni: 0.01-0.6%

Nickel (Ni) has little strength increase effect, however, is effective in improving low-temperature strain aging impact properties, and in particular, when adding Cu, has an effect of suppressing a surface crack by selective oxidation which occurs upon reheating a slab. For this, it is preferable to add 0.01% or more of Ni; however, considering the economic efficiency due to a high price, it is preferable to limit the content to 0.6% or less.

Cr: 0.01-0.2%

Chromium (Cr) has a small effect of increasing yield strength and tensile strength by solid solubilization, however, slows down a cementite decomposition rate during heat treatment after welding or tempering, thereby preventing drop in strength. For this, it is preferable to add 0.01% or more of Cr, however, it is not preferable that the content is more than 0.2%, since manufacturing costs rise, and also low-temperature toughness of the welding heat-affected zone is deteriorated.

Mo: 0.001-0.3%

Molybdenum (Mo) has an effect of delaying transformation in the course of cooling after heat treatment, resulting in a large increase in strength, and also, being effective in preventing drop in strength during heat treatment after welding or tempering like Cr, and preventing toughness decrease by grain boundary segregation of impurities such as P. For this, it is preferable to add 0.001% or more of molybdenum, however, it is also economically disadvantageous to excessively add molybdenum which is an expensive element, and thus, it is preferable to limit the content to 0.3% or less.

Ca: 0.0002-0.0040%

When calcium (Ca) is added after Al deoxidation, Ca is bonded to S which exists as MnS to inhibit production of MnS, simultaneously with formation of globular-shaped CaS, thereby having an effect of suppressing cracks in the center of the steel material. Therefore, in order to form S which is added in the present disclosure into CaS sufficiently, it is preferable to add 0.0002% or more. However, when the content is more than 0.0040%, remaining Ca after forming CaS is bonded to O to produce a coarse oxidative inclusion, which is stretched and fractured in rolling to serve as a crack initiation point.

Therefore, it is preferable in the present disclosure that the content of Ca is limited to 0.0002-0.0040%.

N: 0.006-0.012%

Nitrogen (N) has an effect of being bonded to added Nb, Ti, Al, etc. to forma precipitate, thereby refining the crystal grains of the steel to improve the strength and toughness of a base metal, however, when the content is excessive, precipitates are formed, and remaining N exists in an atom state to cause aging after cold deformation. Thus, nitrogen is known as a representative element to decrease low-temperature toughness. In addition, when manufacturing a slab by continuous casting, surface cracks are promoted by embrittlement at high temperature.

Therefore, considering this, it is preferable in the present disclosure that the content of N is limited to 0.006-0.012%, more advantageously 0.006% or more and less than 0.010%.

P: 0.02% or less (exclusive of 0%)

Phosphorus (P) has an effect of increasing strength when added, however, in the heat-treated steel of the present disclosure, is an element which significantly impairs low-temperature toughness by grain boundary segregation, as compared with the effect of increasing strength, and thus, it is preferable to keep the content of P as low as possible. However, since a significant cost is required to excessively remove P in a steel manufacturing process, it is preferable to limit the content to the range not affecting the physical properties, i.e., 0.02% or less.

S: 0.003% or less (exclusive of 0%)

Sulfur (S) is a representative factor which is bonded to Mn to produce a MnS inclusion in the center of the steel plate in the thickness direction, thereby deteriorating low-temperature toughness. Therefore, it is preferable to keep the content of S as low as possible for securing the low-temperature strain aging impact properties, however, since a significant cost is required to excessively remove this S, it is preferable to limit the content to the range not affecting the physical properties, i.e., 0.003% or less.

The remaining component of the present disclosure is iron (Fe). However, since in the common steel manufacturing process, unintended impurities may be inevitably incorporated from raw materials or the surrounding environment, they may not be excluded. Since these impurities are known to any person skilled in the common steel manufacturing process, the entire contents thereof are not particularly mentioned in the present specification.

It is preferable that the high-strength steel material of the present disclosure satisfying the alloy component composition as described above includes a mixed structure of ferrite, pearlite, bainite and a MA (martensite-austenite) composite phase.

In the structure, ferrite is the most important since it allows the ductile deformation of the steel material, and it is preferable to include this ferrite as a main phase, while finely controlling the average size to 15 μm or less. As such, by refining ferrite crystal grains, a grain boundary may be increased to suppress crack propagation, basic toughness of a steel material may be improved, and also strength increase by an effect of lowering a work hardening rate when cold deformation may be significantly reduced, thereby improving strain aging impact properties simultaneously.

Hard phases including the pearlite, bainite, MA and the like, other than the ferrite, are advantageous for securing high strength by increasing the tensile strength of a steel material, however, such hard phases may serve as the fracture initiation point or propagation path due to high hardness, thereby deteriorating the strain aging impact properties. Therefore, it is preferable to control the fraction, and it is also preferable to limit the sum of fractions of the hard phases to 18% or less (exclusive of 0%).

In particular, since the MA phase has the highest strength, and is transformed from martensite having strong brittleness by deformation, it is a factor which deteriorates the low-temperature toughness most significantly. Therefore, the fraction of the MA phase may be limited preferably to 3.5% or less (exclusive of 0%), and more preferably to 1.0-3.5%.

Meanwhile, the high-strength steel material of the present disclosure having the microstructure as described above includes carbonitrides produced by Nb, Ti, Al, etc., among the added elements, and the carbonitrides inhibits crystal grain growth in the course of rolling, cooling and heat treatment to allow the grains to be fine, and plays an important role in inhibiting crystal grain growth of the welding heat-affected zone when large heat input welding. In order to significantly increase the effect, it is preferable to include 0.01% or more, preferably 0.01-0.06% of the carbonitrides having an average size of 300 nm or less by weight ratio.

Hereinafter, a method for manufacturing a high-strength steel material having excellent low-temperature strain aging impact properties, another aspect of the present disclosure, will be described in detail.

It is preferable that first, a steel slab satisfying the above-described alloy component alloy is manufactured, and then in order to obtain a steel material satisfying a microstructure, carbide conditions and the like aimed for in the present disclosure, hot rolling (controlled rolling), cooling and normalizing heat treatment are performed.

Prior to this, it is preferable to subject the manufactured steel slab to a reheating process.

Herein, it is preferable that the reheating temperature is controlled to 1080-1250° C., and when the reheating temperature is less than 1080° C., re-solid solubilization of carbides produced in the slab during continuous casting is difficult. Therefore, it is preferable to perform reheating to at least a temperature at which 50% or more of added Nb may be solid-solubilized again. However, when the temperature is more than 1250° C., the size of austenite crystal grains is unduly large, so that the mechanical physical properties such as strength and toughness of the finally manufactured steel material are greatly deteriorated.

Therefore, it is preferable in the present disclosure that the reheating temperature is limited to 1080-1250° C.

It is preferable to manufacture the hot-rolled steel plate by finish rolling of the reheated steel slab as described above. Herein, the finish rolling process is preferably controlled rolling, and it is preferable that the rolling end temperature is controlled to 780° C. or more.

When rolling is performed by a common rolling process, the rolling end temperature is about 820-1000° C., however, when this is lowered to less than 780° C., the quenching property is lowered in the region in which Mn and the like are not segregated during rolling, thereby producing ferrite during rolling, and as the ferrite is produced as such, solid-solubilized C and the like are segregated into remaining austenite region and concentrated. Accordingly, the region in which C and the like are concentrated during cooling after rolling is transformed into bainite, martensite or a MA phase, thereby producing a strong layered structure formed of ferrite and a hardened structure. The hardened structure of the layer in which C and the like are concentrated has high hardness and also a greatly increased fraction of the MA phase. As such, since low-temperature toughness is decreased by an increase of hardened structure and arrangement of a layered structure, it is preferable to control the rolling end temperature to 780° C. or more.

The hot-rolled steel plate obtained by controlled rolling according to the above is cooled by air cooling or water cooling, and then is subject to normalizing heat treatment in a constant temperature range, thereby manufacturing a steel material having the desired physical properties.

It is preferable that the normalizing heat treatment is performed by maintaining in a temperature range of 850-960° C. for a certain period of time, and then cooling in the air. When the normalizing heat treatment temperature is less than 850° C., the re-solid solubilization of cementite and a MA phase in pearlite and bainite is difficult to decrease the solid-solubilized C, so that it is difficult to secure strength, and also, a finally remaining hardened phase remains coarse, thereby significantly impairing strain aging impact properties. However, when the temperature is more than 960° C., crystal grain growth occurs to deteriorate the strain aging impact properties.

When the normalizing heat treatment is performed within the temperature range, it is preferable to maintain it for $\{(1.3\times t)+(10-60)\}$ minutes (wherein 't' denotes a steel material thickness (mm)), and when the maintaining time is shorter than that, the uniformity of the structure is difficult, and when the time is longer than that, productivity is deteriorated.

The high-strength steel material obtained according to the above has excellent strength and toughness, and also may effectively prevent toughness decrease by strain aging upon cold deformation, and may secure the impact properties in the welding heat-affected zone well. In particular, a yield ratio (YS (lower yield strength)/TS (tensile strength)) after heat treatment of 0.65-0.80 may be secured.

Mode for Invention

Hereinafter, the present disclosure will be specifically described through the following Examples. However, it should be noted that the following Examples are only for describing the present disclosure in detail by illustration, and not intended to limit the right scope of the present disclosure. The reason is that the rights scope of the present disclosure is determined by the matters described in the claims and matters able to be reasonably inferred therefrom.

Examples

The steel slabs having the component composition shown in the following Table 1 were subjected to reheating, hot rolling and normalizing heat treatment under the conditions shown in the following Table 2, thereby manufacturing hot-rolled steel plates having a final thickness of 6 mm or more.

The microstructure fraction, size and carbonitride fraction of each of the manufactured hot-rolled steel plates were measured. In addition, A Charpy impact transition temperature was measured in the state of being aged at 250° C. for 1 hour after 5% stretching of a cold deformation amount, which may represent strength (tensile strength and yield strength) and strain aging impact properties of each hot-rolled steel plate, and represented in the following Table 3.

For the microstructure of each hot-rolled steel plate, the steel plate section was polished to a mirror surface, and etched with Nital or Lepera as desired, thereby measuring an image for a certain area of a specimen at 100-500× magnification with an optical or scanning electron microscope, and then the fraction of each image was measured from the measured images using an image analyzer. In order to obtain a statistically significant value, the measurement was repeated for the same specimen but at the changed position, and the average value was calculated.

The fraction of the fine carbonitrides having an average size of 300 nm or less was measured by an extraction residue method.

As tensile property values, lower yield strength, tensile strength and a yield ratio (lower yield strength/tensile strength) were measured, respectively from a nominal strain-nominal stress curve obtained by a common tensile test, and a strain aging impact property value was measured by adding 0%, 5% and 8% in advance as a tensile strain, aging a stretched specimen at 250° C. for 1 hour, and then performing a Charpy V-notch impact test.

For welding evaluation, a joint specimen was manufactured by subjecting each hot-rolled steel plate to multilayer welding in a range of heat input of 7-50 kJ/cm, using a submerged arc welding (SAW) method which is widely used in joining of a steel material for a structure, and processing an impact specimen so that a welding heat-affected zone (HAZ) corresponds to a notch of a Charpy impact specimen, thereby measuring an impact absorption energy value.

TABLE 1

| Steel type | Component composition (wt %) | | | | | | | | | | | | | | |
|---|---|---|---|---|---|---|---|---|---|---|---|---|---|---|---|
| | C | Si | Mn | P | S | Sol. Al | Cu | Ni | Cr | Mo | Ti | Nb | V | N | Ca |
| 1 | 0.069 | 0.42 | 1.59 | 0.011 | 0.0014 | 0.029 | 0.19 | 0.30 | 0.08 | 0.11 | 0.013 | 0.026 | 0.003 | 0.0073 | 0.0010 |
| 2 | 0.111 | 0.37 | 1.44 | 0.013 | 0.0026 | 0.037 | 0.06 | 0.07 | 0.15 | 0.04 | 0.021 | 0.031 | 0.003 | 0.0097 | 0.0022 |
| 3 | 0.037 | 0.40 | 1.66 | 0.011 | 0.0023 | 0.040 | 0.17 | 0.05 | 0.06 | 0.12 | 0.017 | 0.026 | 0.003 | 0.0069 | 0.0024 |
| 4 | 0.167 | 0.30 | 0.86 | 0.012 | 0.0026 | 0.022 | 0.04 | 0.17 | 0.09 | 0.08 | 0.022 | 0.014 | 0.002 | 0.0093 | 0.0014 |
| 5 | 0.111 | 0.41 | 1.50 | 0.017 | 0.0010 | 0.034 | 0.08 | 0.05 | 0.13 | 0.08 | 0.037 | 0.018 | 0.004 | 0.0083 | 0.0021 |
| 6 | 0.064 | 0.45 | 1.26 | 0.007 | 0.0010 | 0.021 | 0.11 | 0.06 | 0.07 | 0.07 | 0.021 | 0.003 | 0.003 | 0.0077 | 0.0009 |
| 7 | 0.091 | 0.24 | 1.35 | 0.006 | 0.0015 | 0.011 | 0.22 | 0.13 | 0.14 | 0.07 | 0.018 | 0.021 | 0.002 | 0.0190 | 0.0017 |
| 8 | 0.136 | 0.27 | 1.57 | 0.007 | 0.0023 | 0.014 | 0.34 | 0.08 | 0.05 | 0.02 | 0.023 | 0.028 | 0.001 | 0.0040 | 0.0009 |

TABLE 2

| Steel type | Product thickness (mm) | Reheating temperature (° C.) | Rolling end temperature (° C.) | Normalizing temperature (° C.) | Normalizing time (min) | Welding heat input (kJ/cm) | Classification |
|---|---|---|---|---|---|---|---|
| 1 | 100.0 | 1191 | 990 | 906 | 155 | 50 | Inventive Example 1 |
| 2 | 76.0 | 1175 | 927 | 906 | 119 | 45 | Inventive Example 2 |
| 2 | 76.0 | 1190 | 913 | 904 | 128 | 45 | Inventive Example 3 |
| 1 | 76.0 | 1156 | 760 | 920 | 42 | 45 | Comparative Example 1 |
| 2 | 76.0 | 1037 | 894 | 915 | 126 | 45 | Comparative Example 2 |
| 3 | 25.0 | 1172 | 938 | 916 | 95 | 7 | Comparative Example 3 |

TABLE 2-continued

| Steel type | Product thickness (mm) | Reheating temperature (° C.) | Rolling end temperature (° C.) | Normalizing temperature (° C.) | Normalizing time (min) | Welding heat input (kJ/cm) | Classification |
|---|---|---|---|---|---|---|---|
| 4 | 51.0 | 1157 | 991 | 889 | 93 | 35 | Comparative Example 4 |
| 5 | 100.0 | 1186 | 949 | 926 | 155 | 50 | Comparative Example 5 |
| 6 | 76.0 | 1172 | 890 | 906 | 115 | 35 | Comparative Example 6 |
| 7 | 51.0 | 1164 | 945 | 928 | 82 | 25 | Comparative Example 7 |
| 8 | 76.0 | 1108 | 868 | 913 | 59 | 35 | Comparative Example 8 |

TABLE 3

| Classification | Microstructure | | | | | Mechanical physical properties | | | | |
|---|---|---|---|---|---|---|---|---|---|---|
| | F Fraction (%) | F Size (μm) | Hardened phase Fraction (%) | MA Fraction (%) | Carbonitride Fraction (%) | Lower yield strength (MPa) | Tensile strength (MPa) | Yield ratio | 5% strain aging DBTT temperature (° C.) | HAZ impact energy (J, −40° C.) |
| Inventive Ex. 1 | 92.0 | 9.8 | 8.0 | 2.8 | 0.036 | 384 | 509 | 0.75 | −61 | 92 |
| Inventive Ex. 2 | 87.2 | 9.0 | 12.8 | 3.3 | 0.040 | 378 | 543 | 0.70 | −59 | 87 |
| Inventive Ex. 3 | 86.5 | 9.9 | 13.5 | 2.3 | 0.059 | 375 | 526 | 0.71 | −54 | 81 |
| Comparative Ex. 1 | 92.2 | 8.7 | 7.8 | 1.9 | 0.014 | 390 | 561 | 0.70 | −34 | 71 |
| Comparative Ex. 2 | 87.0 | 9.0 | 13.0 | 3.0 | 0.042 | 319 | 448 | 0.71 | −51 | 85 |
| Comparative Ex. 3 | 97.0 | 17.3 | 3.0 | 1.7 | 0.013 | 339 | 430 | 0.79 | −77 | 123 |
| Comparative Ex. 4 | 79.9 | 8.9 | 20.1 | 3.9 | 0.028 | 377 | 617 | 0.61 | −32 | 26 |

TABLE 3-continued

| | Microstructure | | | | | Mechanical physical properties | | | | |
|---|---|---|---|---|---|---|---|---|---|---|
| Classification | F Fraction (%) | F Size (μm) | Hardened phase Fraction (%) | MA Fraction (%) | Carbonitride Fraction (%) | Lower yield strength (MPa) | Tensile strength (MPa) | Yield ratio | 5% strain aging DBTT temperature (° C.) | HAZ impact energy (J, −40° C.) |
| Comparative Ex. 5 | 86.2 | 8.6 | 13.8 | 3.0 | 0.027 | 383 | 531 | 0.72 | −28 | 25 |
| Comparative Ex. 6 | 93.3 | 9.3 | 6.7 | 1.3 | 0.008 | 339 | 457 | 0.74 | −66 | 112 |
| Comparative Ex. 7 | 89.8 | 9.4 | 10.2 | 2.3 | 0.016 | 356 | 465 | 0.77 | −31 | 21 |
| Comparative Ex. 8 | 83.5 | 10.4 | 16.5 | 2.4 | 0.022 | 397 | 561 | 0.71 | −36 | 16 |

(In the above Table 3, 'F fraction' refers to a ferrite fraction, and 'F size' refers to an average size of ferrite crystal grains.

In addition, the represented hardened phase fraction (%) includes the carbonitride fraction (%).)

As shown in the above Tables 1 to 3, the hot-rolled steel plate satisfying all of the component composition and manufacturing conditions of the present disclosure has high strength, and also secures excellent low-temperature toughness even after cold deformation, and secures welding heat-affected zone low-temperature toughness well after large heat input welding, thereby being appropriately used in pressure vessels, offshore structures and the like, following a trend of being larger and more complicated.

However, though the steel component composition satisfies the present disclosure, in Comparative Example 1 in which the roll end temperature upon hot rolling after reheating was unduly low, a strong layered structure formed of ferrite and hardened structure was produced, and thus, low-temperature toughness was decreased, and the impact transition temperature after 5% cold deformation was shown to be higher, −34° C.

In addition, in Comparative Example 2 in which reheating temperature was unduly low, added Nb was not sufficiently solid-solubilized again, so that a strengthen effect by phase transformation control or precipitation by Nb was significantly small, and thus, low yield strength was less than 350 MPa, and tensile strength was less than 500 MPa.

Meanwhile, in Comparative Examples 3 to 7 in which the manufacturing conditions satisfied the present disclosure, but the steel component composition did not satisfy the present disclosure, low strength or deteriorated low-temperature toughness were confirmed.

Thereamong, in Comparative Example 3 in which the content of C was not sufficient, the ferrite crystal grains were produced coarse when rolling and heat treating, so that sufficient strength was not secured.

In Comparative Example 4 in which the content of C was excessive, a hardened phase fraction was more than 18%, and the fraction of MA phase was greatly increased, thereby lowering the yield ratio, resulting in high impact transition temperature after 5% cold deformation.

In Comparative Example 5 in which the content of Ti is excessive, Ti which was excessively added as compared with added N was produced as a coarse TiN precipitate, and when impacted after 5% cold deformation, served as an initiation point of cracks, resulting in higher impact transition temperature, and deteriorated welding heat-affected zone low-temperature toughness.

In Comparative Example 6 in which the content of Nb was insufficient, due to phase transformation delay by Nb re-solid solubilization, a strengthening effect by crystal grain refining and precipitation producing was not exhibited to deteriorate strength.

In Comparative Example 7 in which the content of N was excessive, the excessive added N as compared with added Ti existed as N in the state of being solid-solubilized even after normalizing heat treatment or welding, and thus, transition temperature after 5% cold deformation was shown to be high, and welding heat-affected zone low-temperature toughness was deteriorated.

In Comparative Example 8 in which the content of N was insufficient, the content of N was insignificant as compared with added Ti, so that a TiN precipitate was produced at a higher temperature to be coarser, and did not contribute crystal grain refining, and thus, transition temperature after 5% cold deformation was shown to be high, and welding heat-affected zone low-temperature toughness was deteriorated.

The invention claimed is:

1. A steel material comprising: 0.04-0.14 wt % of carbon, 0.05-0.60 wt % of silicon, 0.6-1.8 wt % of manganese, 0.005-0.06 wt % of soluble aluminum, 0.005-0.05 wt % of niobium, 0.01 wt % or less, exclusive of 0 wt %, of vanadium, 0.012-0.030 wt % of titanium, 0.01-0.4 wt % of copper, 0.01-0.6 wt % of nickel, 0.01-0.2 wt % of chromium, 0.001-0.3 wt % of molybdenum, 0.0002-0.0040 wt % of calcium, 0.006-0.012 wt % of nitrogen, 0.02 wt % or less, exclusive of 0 wt %, of phosphorus, and 0.003 wt % or less, exclusive of 0 wt %, of sulfur, with a balance of Fe and inevitable impurities, and comprising a mixed structure of ferrite, pearlite, bainite and a martensite-austenite composite phase as a microstructure, wherein an area percent of the martensite-austenite composite phase is 3.5% or less, exclusive of 0%, wherein an area percent of ferrite is 82% or more and less than 100%.

2. The steel material of claim 1, wherein the niobium is comprised in an amount of 0.02-0.05 wt %, and the nitrogen is comprised in an amount of 0.006 wt % or more and less than 0.010 wt %.

3. The steel material of claim 1, wherein an average ferrite crystal grain size is 15 μm or less.

4. The steel material of claim 1, comprising 0.01 wt % or more of carbonitrides having an average size of 300 nm or less.

5. The steel material of claim 1, wherein a yield ratio is 0.65-0.80.

* * * * *